United States Patent [19]

Riddell

[11] Patent Number: 4,773,541

[45] Date of Patent: Sep. 27, 1988

[54] PACKAGE WITH TEAR-AWAY OPENING INCLUDING AN INNER PULL STRIP AND OUTER GUIDE TAPE

[75] Inventor: Wilfred E. Riddell, Neenah, Wis.

[73] Assignee: Kimberly-Clark Corporation, Neenah, Wis.

[21] Appl. No.: 22,457

[22] Filed: Mar. 6, 1987

[51] Int. Cl.[4] ..... B65D 3/26

[52] U.S. Cl. ..... 206/606; 206/391; 206/615; 206/630

[58] Field of Search ..... 206/601, 602, 605, 606, 206/614, 616, 630, 610, 613, 615, 391, 394

[56] References Cited

U.S. PATENT DOCUMENTS

| | | | |
|---|---|---|---|
| 1,978,035 | 10/1934 | Thom | 206/616 |
| 2,120,629 | 6/1938 | Shunemann | 206/606 X |
| 2,517,801 | 8/1950 | Rousch | 206/616 |
| 3,043,490 | 7/1962 | Burnett | 206/614 X |
| 3,276,666 | 10/1966 | Johnson | 206/606 |
| 3,539,093 | 11/1970 | Massengill | 206/606 |
| 3,884,348 | 5/1975 | Ross | 206/606 X |
| 4,093,073 | 6/1978 | Leezer | 206/606 |
| 4,621,736 | 11/1986 | Roccaforte | 206/606 |

FOREIGN PATENT DOCUMENTS

| | | | |
|---|---|---|---|
| 1139065 | 10/1962 | Fed. Rep. of Germany | 206/606 |

*Primary Examiner*—Stephen Marcus
*Assistant Examiner*—Bryon Gehman
*Attorney, Agent, or Firm*—Gregory E. Croft

[57] ABSTRACT

A kraft paper package contains at least one tear-away opening means which comprises: (1) a pull strip affixed to and circumscribing the inside of the package; and (2) a guide tape affixed to the outside of the package in parallel juxtaposition with the pull strip. When the package is opened, the package is sheared in a straight line between the edges of the pull strip and guide tape, resulting in a clean reinforced edge.

5 Claims, 2 Drawing Sheets

PACKAGE WITH TEAR-AWAY OPENING INCLUDING AN INNER PULL STRIP AND OUTER GUIDE TAPE

BACKGROUND

In the manufacture and distribution of roll products such as paper towels, it is common practice to package a dozen or so rolls into a cardboard box for shipping. When the box arrives at the retail shelf, it is opened up and the rolls are removed and individually stacked on the shelf. This procedure is time consuming for the retailer, and the cardboard boxes are expensive for the manufacturer. Therefore there is a need for a package which is less expensive and more convenient for purposes of retail shelf display.

SUMMARY OF THE INVENTION

It has now been discovered that a heavy duty kraft paper bundle or other similar package having an appropriate tear-away opening feature can serve the dual purposes of a shipping container and a retail display container. This new packaging concept provides a cost savinSs to the manufacturer as well as providing greater convenience to retailers.

In general, the invention resides in a package having at least one opening means comprising: a pull strip affixed to and circumscribing the inside of the package and which protrudes therefrom; and at least one guide tape affixed to and circumscribing the outside of the package in parallel juxtaposition with the pull strip, wherein upon pulling the pull strip out of the package, the package is sheared open along a line where the pull strip and guide tape pass each other. (For purposes herein, "parallel juxtaposition" of the guide tape and the pull strip means that the pull strip is positioned beneath the guide tape to the extent that at least one edge, and preferably both edges, of the pull strip is overlapped or covered by: the guide tape.) This unique opening means provides a very clean opened edge to the package which is also reinforced by the remaining guide tape. The top and bottom portions of the opened package can be used as trays for displaying the contents of the package on the retail shelf, which saves tiae in unpacking and stacking.

The guide tapes useful for purposes of this invention must possess a propensity for tearing only in the lengthwise direction. This can be accomplished by a high degree of molecular orientation or, preferably, by lengthwise fiber reinforcement. Such fiber-reinforced tapes are well-known commercially available products. Suitable tapes are available from H. B. Fuller Company under the trademark Sesame Tape.

Without proper lengthwise reinforcement, the edges of the guide tape will stretch, allowing the tear opening to propagate under the guide, thereby resulting in a ragged edge. This is particularly true when ply-separable paper packaging materials are used, such as kraft paper. For example, non-reinforced polyester and polypropylene tapes, such as are commonly known as Scotch brand tapes, do not perform well as guide tapes. It has been found that as the pull strip is forced through such guide tapes, elongation of the guide tape occurs, beginning at the edges, rather than tearing. This elongation results in a loss of control of the direction of the tear and ply separation of the kraft paper. Although the tear opening still generally follows the position of the pull strip as one might expect, the surface ply or layer of the kraft paper tears uncontrollably, resulting in a very ragged edge. Also, if the outer surface of the kraft paper contains printed matter next to the intended tear opening, the printed matter may be removed with the surface layer of the kraft paper.

The pull strips can be any suitable tape or string which can be sufficiently adhered to the inside of the package material and is sufficiently strong to tear through the package upon opening. The fiber-reinforced guide tape materials are particularly suitable for use as pull strips.

The packaging material can be any material which provides the necessary shipping and display stiffness and durability, yet has sufficiently low tear strength to permit opening of the package. Suitable packaging materials include paper, polyethylene films, oriented polypropylene films, etc. Kraft paper is preferred because of its strength and economy. The precise basis weight of the kraft paper will vary. with the strength and durability necessary for a particular application. A preferred basis weight range is from about 30–80 pounds per 2880 square feet.

The invention will now be more clearly described with reference to the Drawing.

DETAILED DESCRIPTION OF THE DRAWING

Figure 1:
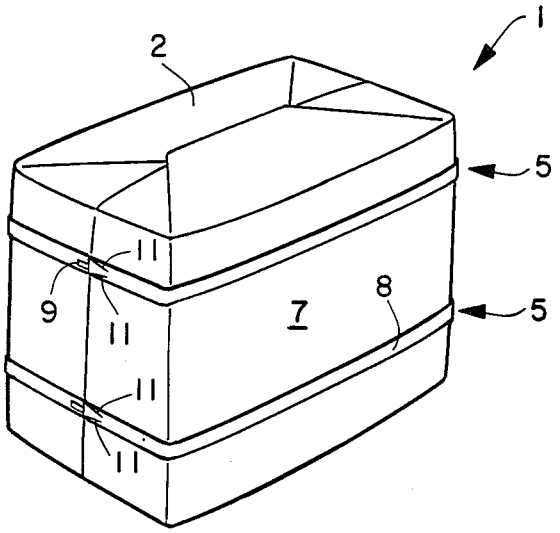
FIG. 1 is a perspective view of a bundled package of rolled paper towels having two spaced-apart opening means in accordance with this invention.

Directing attention to FIG. 1, shown is a kraft paper bundled package 1 particularly suitable for shipping rolls of paper towels in quantities of about 12–15 rolls per package. The package comprises a single sheet of kraft paper which has been wrapped around the product and appropriately folded at the top 2 and bottom (not shown) of the package. Bundling or wrapping apparatus and methods for accomplishing this type of packaging are available commercially and are well known in the art. Also shown in FIG. 1 are two spaced-apart opening means 5 circumscribing the package which, in the preferred embodiment shown, are located about five inches from the top and bottom of the package respectively. This ultimately provides, upon opening of the package, two five inch high display trays for the paper towel rolls contained therein. This height not only provides sufficient support for the contents of the tray on the retail shelf, but is also low enough for the prospective purchaser to see the graphics on the individual roll packages. As shown each of the opening means circumscribes the sidewall 7 of the entire package. While it is within the scope of this invention to divide each opening means into two or more segments, such as, for example, each segment circumscribing half of the package, it is preferred that each opening means be continuous so that the package can be completely opened with a continuous motion.

As previously mentioned, each opening means comprises two major components, namely a guide tape 8 affixed to the outside of the package in parallel juxtaposition with a pull strip 9 affixed to the inside of the package, one end of which extends outside the package sufficiently to be grasped for opening. The guide tape and pull strip are attached to the kraft paper sheet prior to formation of the bundle, preferably with hot melt adhesive to provide good bonding to the paper. Other adhesive attachment means can also be used, however, including tapes backed with a preapplied pressure sensitive adhesive. It is preferable, but not necessary, that the guide tape contain starter slits 11 which initially direct the tearing of the guide tape in the proper direction to get the opening tear started.

Figure 2:
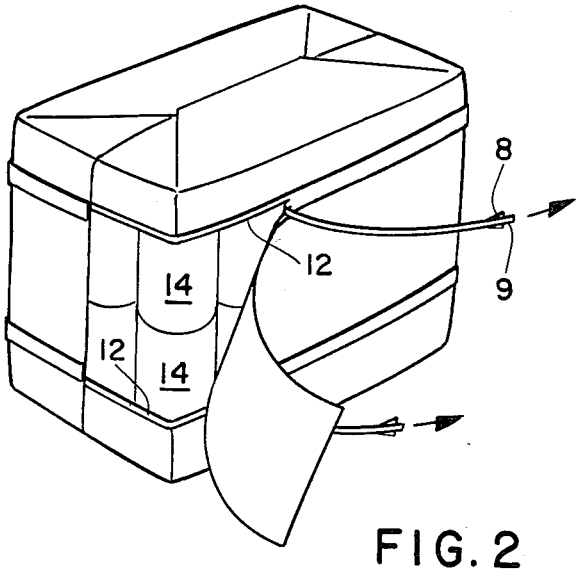
FIG. 2 is a perspective view of the same package in the process of being opened.

FIG. 2 illustrates the package of FIG. 1 in the process of being opened. As the pull strip 9 is pulled out, a central portion of the guide tape is removed with the pull strip. At the same time, the sidewall 7 is sheared along two edges, leaving behind at least one clean reinforced edge 12 which will provide edge support and integrity to the resulting trays and also a neat appearance for display purposes. This is facilitated by the lengthwise fiber reinforcement or the molecular orientation of the guide tape which provides a strong propensity to tear only in the lengthwise direction without elongation and edge stretching. Also shown in FIG. 2 are the rolls of paper towels 14 or the like within the package. In a specific embodiment which has been found to work well, the guide tape is about ½ inch wide and the pull strip is a lengthwise fiber-reinforced tape about ¼ inch wide.

Figure 3:
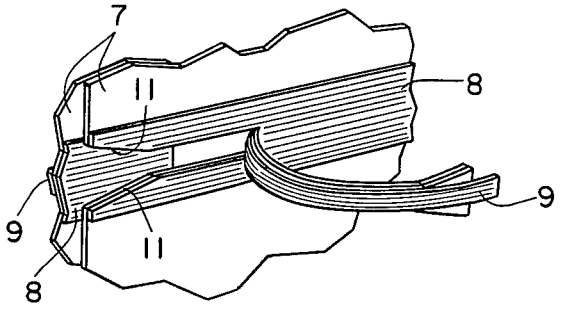
FIG. 3 is a close-up cut-away view of a portion of the opening means as the package is initially being opened.

FIG. 3 is a cut-away view of the opening means of the package of FIGS. 1 and 2, more clearly illustrating the pull strips and guide tapes. As shown, the formation of the package results in an overlap of the ends of the kraft paper sidewall 7, which overlapped portion is suitably glued or otherwise sealed to complete the package. At this point the end of the pull strip 9 is exposed. The guide tape 9 preferably has two starter slits 11 which aid in getting the opening properly started. As the package is opened, a portion of the guide tape is pulled away with the pull strip as shown.

Figure 4:
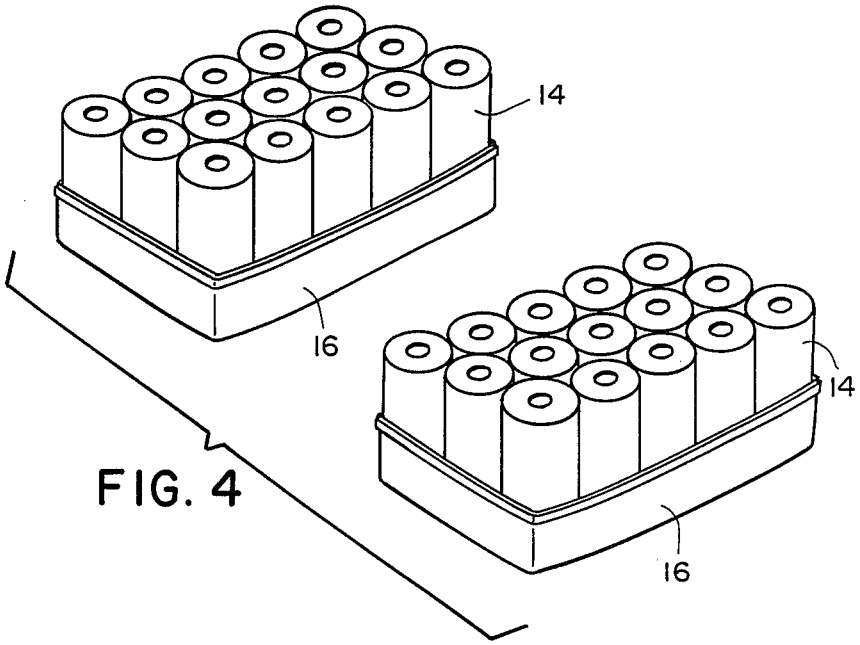
FIG. 4 is a perspective view of the opened package with the center portion of the original package between the two opening means removed, illustrating the resulting two trays of paper towel rolls ready for retail display.

FIG. 4 illustrates the two trays 16 containing the bundled products which result upon removal of the center portion of the sidewall of the package. Because of the flexibility of the kraft paper, the guide tape remaining on the upper edge of each tray provides structural reinforcement as well as a clean edge for display purposes. Hence, when the package is shipped to the retailer, the retailer need only tear open the package, invert one of the trays with the product in place, and place both trays on the display shelf. There is no need to empty a box and individually place each roll of product on the shelf.

Figure 5:
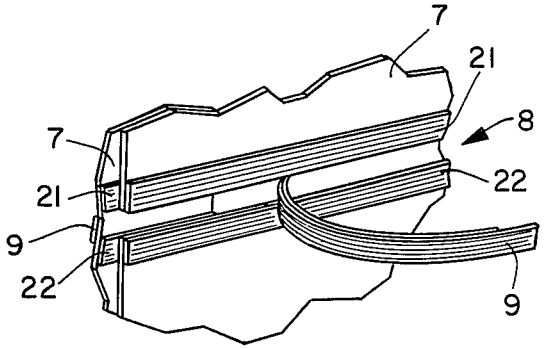
FIG. 5 is a close-up cut-away view of an alternative embodiment of an opening means in accordance with this invention.

FIG. 5 illustrates an alternative embodiment for the opening means of the package of this invention. In this embodiment, the guide tape comprises two spaced apart individual fiber reinforced tapes 21 and 22 positioned on either side of the pull strip 9. The spacing between the two guide tapes must be about equal to or, preferably, less than the width of the pull strip, which causes the paper to shear along a line where the pull strip edges and the guide tape edges pass each other. This forces the tear to propagate along the edges of the guide tape rather than in-between, assuring a clean edge for the resulting trays. A suitable specific embodiment utilizes two guide tapes about ¼ inch wide and which are spaced apart slightly less than ¼ inch. The pull strip is about ¼ inch wide and is centered between the guide tapes.

I claim:

1. A package having at least one opening means, said opening means comprising: a pull strip affixed to and circumscribing the inside of the package and which protrudes thereform; and one lengthwise fiber-reinforced guide tape affixed to and circumscribing the outside of the package and positioned to completely cover the pull strip such that a central portion of the guide tape is removed with the pull strip when the package is opened.

2. The package of claim 1 having two opening means.

3. The package of claim 1 wherein the package material is kraft paper.

4. A kraft paper package having at least one opening means, said opening means comprising: a lengthwise fiber-reinforced tape pull strip affixed to and circumscribing the inside of the package and which protrudes therefrom; and one lengthwise fiber-reinforced guide tape affixed to and circumscribing the outside of the package and positioned to completely cover the pull strip such that a central portion of the guide tape is removed with the pull strip when the package is opened.

5. The package of claim 4 wherein the number of opening means is two.

* * * * *